US005947806A

United States Patent [19]

Rhoads

[11] Patent Number: 5,947,806

[45] Date of Patent: Sep. 7, 1999

[54] POWER SANDER

[76] Inventor: Mitchell L. Rhoads, 18067 E. Berry Ave., Aurora, Calif. 80015

[21] Appl. No.: 08/935,878

[22] Filed: Sep. 23, 1997

[51] Int. Cl.[6] ..... B24B 23/00

[52] U.S. Cl. ..... 451/358; 451/344; 451/507; 451/178

[58] Field of Search ..... 451/358, 344, 451/913, 507, 178, 541, 504; 384/535, 906

[56] References Cited

U.S. PATENT DOCUMENTS

| | | | |
|---|---|---|---|
| 1,646,852 | 10/1927 | Carnowsky et al. | 451/178 |
| 2,259,685 | 10/1941 | Elsloo | 51/194 |
| 2,554,763 | 5/1951 | Wickman | 51/190 |
| 3,381,418 | 5/1968 | Eisbrenner | 51/170 |
| 3,596,411 | 8/1971 | Hutchins | 51/170 |
| 3,656,920 | 4/1972 | Helms . | |
| 3,844,360 | 10/1974 | Green et al. . | |
| 3,848,374 | 11/1974 | Hasegawa . | |
| 3,869,832 | 3/1975 | Atwater | 51/170 PT |
| 4,558,538 | 12/1985 | Green . | |
| 4,885,876 | 12/1989 | Henke . | |
| 4,930,267 | 6/1990 | Hill et al. . | |
| 5,172,522 | 12/1992 | Jares . | |
| 5,185,970 | 2/1993 | Fiocchi | 51/372 |
| 5,205,079 | 4/1993 | Lashley et al. . | |
| 5,239,783 | 8/1993 | Matechuk . | |
| 5,259,914 | 11/1993 | Fisher | 156/584 |
| 5,269,874 | 12/1993 | Winter | 156/584 |
| 5,301,472 | 4/1994 | Lyng . | |
| 5,408,794 | 4/1995 | Lyng . | |
| 5,672,096 | 9/1997 | Amarosa, Sr. et al. | 451/504 |

OTHER PUBLICATIONS

"Pneumatic Drum Sanders", *Catalog No. PS–8,* Ekstrom, Carlson & Co., Small Tools Division, 3 Pages, (Aug. 1992).

"Sun White Abrasives", *Catalog #94,* Industrial Abrasives Co., 2 Pages, (1994).

*Primary Examiner*—David A. Scherbel
*Assistant Examiner*—Dung Van Nguyen
*Attorney, Agent, or Firm*—Schwegman Lundberg Woessner & Kluth, P.A.

[57] ABSTRACT

A power sander. The power sander includes a unitary motor shaft, first and second handles and a sanding assembly. The second handle is a stabilizing handle that is detachably coupled to the motor shaft. The first and second handles and the sanding assembly are in axial alignment on the motor shaft.

19 Claims, 2 Drawing Sheets

POWER SANDER

TECHNICAL FIELD OF THE INVENTION

The present invention relates generally to the field of power tools and, in particular, to a power sander.

BACKGROUND OF THE INVENTION

In woodworking, a power sander is often used to smooth or alter the shape of a piece of wood. When sanding contours, e.g., on the edge of the wood, a drum sander is typically placed on a portion of the wood with a small surface area and manipulated with a single handle to pass back and forth over the wood to smooth and shape the surface of the contour. Unfortunately, conventional drum sanders prove to be very unstable when used in this manner and can damage a piece of wood if not controlled properly.

One power sander is described in U.S. Pat. No. 3,656,920 that issued to Hosea W. Helms on Apr. 18, 1972 (the "Helms patent"). The Helms patent describes a power sanding device for sanding irregular surfaces with an abrasive cylinder mounted on a drive shaft. The power sanding device includes a radial handle rotatably mounted on one end of the drive shaft and a flexible shaft, disposed at an opposite end of the drive shaft, that is capable of transmitting torque through an angle to the drive shaft. The flexible shaft is connectable to a portable power drill to rotate the abrasive cylinder. This allows a user to keep the common axes of the knuckles of each hand generally perpendicular to the axis of the abrasive cylinder. However, the Helms patent describes a sanding device with a limited range of capabilities.

Pneumatic drum sanders are described in Catalog No. PS-8 from Ekstrom, Carlson & Co., Small Tools Division of Rockford, Ill. These sanders include an air-inflated drum with a ball bearing handle. A detachable air tool or a power drill powers the sander. When the air tool is used, an air inlet port is coupled to a source of compressed air. Unfortunately, these drum sanders also have a limited range of capabilities and are typically used in combination with other equipment.

For the reasons stated above, and for other reasons stated below which will become apparent to those skilled in the art upon reading and understanding the present specification, there is a need in the art for a versatile, power sander with increased stability when sanding contours.

SUMMARY OF THE INVENTION

The above mentioned problems with power sanders and other problems are addressed by the present invention and which will be understood by reading and studying the following specification. A power sander is described which includes a second, removable stabilizing handle located coaxially with the sanding element that allows the power sander to be more easily used when sanding contours. The second handle can be removed to allow use of the power sander in other operations.

In particular, one embodiment of the present invention provides a power sander. The power sander includes an electric motor. A motor shaft assembly extends axially from the electric motor. A first handle houses the electric motor with the motor shaft assembly extending from one end of the first handle along an axis of the first handle. The power sander also includes a sanding assembly that is located coaxial with the motor shaft assembly. The sanding assembly is engageably coupled with the motor shaft assembly so as to rotate around the axis of the motor shaft assembly under control of the electric motor. The power sander also includes a stabilizing, second handle that is detachably coupled to the motor shaft assembly on a side of the sanding assembly opposite, and coaxial with the first handle.

In another embodiment, a power sander is provided. The power sander includes a unitary motor shaft, a first handle, a sanding assembly, and a stabilizing, second handle that is detachably coupled to the motor shaft. The first and second handles and the sanding assembly are in axial alignment on the motor shaft.

In another embodiment, a power sander is provided. The power sander includes a unitary motor shaft, a first handle, and a stabilizing, second handle. The second handle is detachably coupled to the motor shaft. The first and second handles are in axial alignment with the motor shaft so as to provide a space between the first and second handles to receive a sanding assembly.

DETAILED DESCRIPTION

In the following detailed description, reference is made to the accompanying drawings that form a part of the specification. The drawings show by way of illustration specific illustrative embodiments in which the invention may be practiced. These embodiments are described in sufficient detail to enable those skilled in the art to practice the invention. It is to be understood that other embodiments may be utilized and that logical, mechanical and electrical changes may be made without departing from the spirit and scope of the present invention. The following detailed description is, therefore, not to be taken in a limiting sense.

Figure 1:
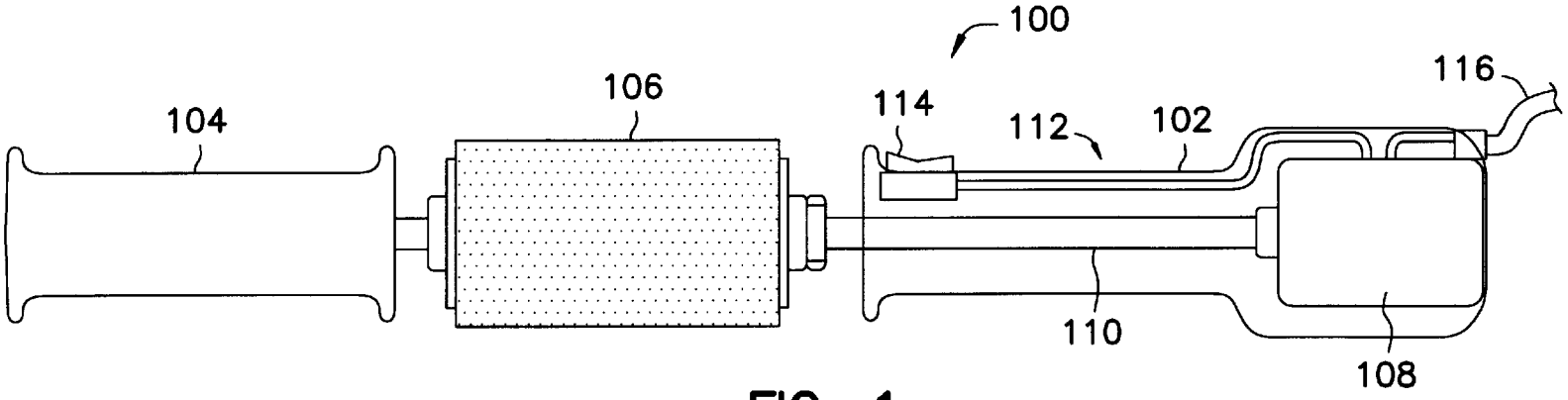
FIG. 1 is a side view in elevation of an embodiment of a power sander constructed according to the teachings of the present invention.
Figure 3:
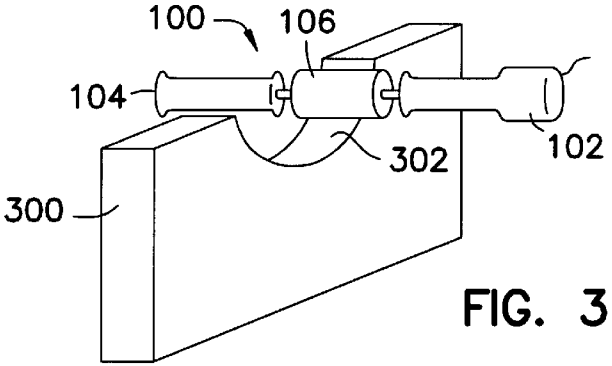
FIG. 3 is a perspective view of an embodiment of a power sander that illustrates use of the power sander in sanding a contour on an edge of a piece of wood.

FIG. 1 is a side view in elevation of an embodiment of a power sander, indicated generally at 100, that is constructed according to the teachings of the present invention. Advantageously, power sander 100 uses two, coaxial handles that are disposed on opposite sides of sanding assembly 106. Advantageously, this increases the stability of operation of power sander 100 when sanding, for example, contours on a piece of wood as shown in FIG. 3. Power sander 100 includes first handle 102 that is fixedly coupled to sanding assembly 106 and that houses electric motor 108. Motor shaft assembly 110 extends axially from electric motor 108 toward sanding assembly 106. Sanding assembly 106 may comprise, for example, a sandpaper sleeve held in place on a rotatable, rubber drum.

Figure 4:
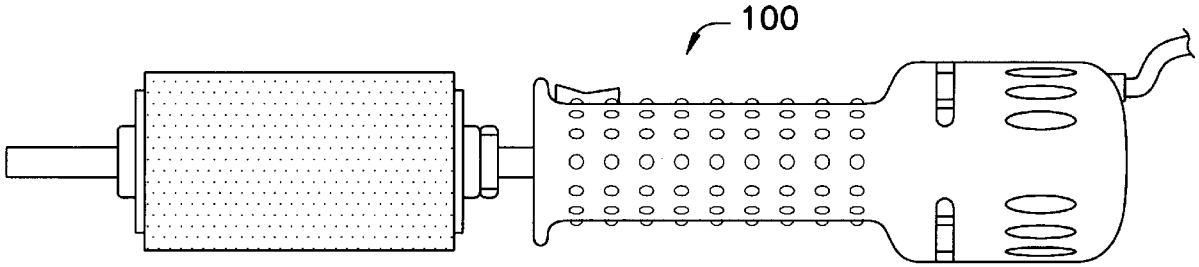
FIG. 4 is a side view in elevation of another embodiment of a power sander constructed according to the teachings of the present invention.

Second handle 104 is removeably and rotatably coupled to motor shaft assembly 110 on a side of sanding assembly 106 that is opposite from first handle 102. Since second handle 104 can be removed, power sander 100 provides the flexibility of use in both one-handed and two-handed applications and works equally well for left-handed and right-handed operators. When second handle 104 is removed, power sander 100 can be used in typical end sander or drum sander operations as shown for example in FIGS. 4 and 5.

In this embodiment, first handle 102 includes a tapered portion 112 that can be used to grasp power sander 100. Switch 114 is advantageously disposed in first handle 102 so as to be engageable by a thumb of a person grasping handle 102 at tapered portion 112. Switch 114 is electrically coupled to electric motor 108. Electric motor 108 comprises, for example, a variable speed electric motor. Switch 114 controls both power and speed for electric motor 108. In one embodiment, electric motor 108 is coupled to an external power supply (not shown) by electric power cord 116. Alternatively, a rechargeable battery (not shown) co-located in or adjacent to first handle 102 could provide power to electric motor 108.

In one embodiment, motor shaft assembly 110 includes a single piece drive shaft. Alternatively, motor shaft assembly 110 could include a fixed, inner shaft that extends axially through the center of a rotating shaft. In this manner the fixed shaft can be used to keep the first and second handles in stationary alignment.

In operation, power sander 100 can be used to sand a contour as shown in FIG. 3. To accomplish this, a user grasps power sander 100 using both first and second handles 102 and 104. The user engages motor 108 by depressing switch 114. This causes motor 108 to rotate a shaft in motor shaft assembly 110. Sanding assembly 106 rotates under the influence of motor shaft assembly 110. Sanding assembly 106, thus, is used to smooth or shape the edge 302 of wood 300.

Figure 2:
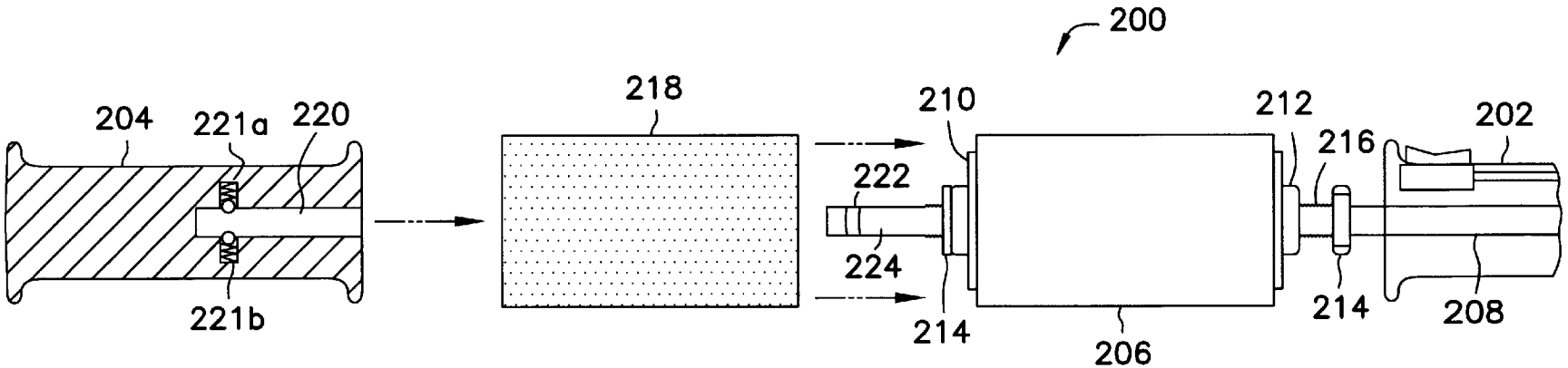
FIG. 2 is an exploded side view in elevation and partial cross section of an embodiment of a power sander constructed according to the teachings of the present invention.

FIG. 2 is a partial exploded side view in elevation and partial cross section of an embodiment of a power sander, indicated generally at 200, constructed according to the teachings of the present invention. Power sander 200 includes first handle 202 and second handle 204. Motor shaft assembly 208 extends from first handle 202. Further, power sander 200 includes rubber drum 206 that is coupled to motor shaft assembly 208 so as to rotate under the influence of motor shaft assembly 208. Rubber drum 206 is disposed between first and second end abutments 210 and 212, respectively. First, and second end abutments 210 and 212, respectively are slidably coupled to motor shaft assembly 208. Nuts 214 are disposed on threaded portion 216 of motor shaft assembly 208. By tightening one or both nuts 214, first and second end abutments 210 and 212 move toward each other and cause rubber drum 206 to compress axially and expand radially so as to hold sanding element 218, e.g., a sandpaper sleeve, in place during a sanding operation. Conversely, by loosening one or both nuts 214, first and second end abutments 210 and 212 move away from each other and allow rubber drum 206 to contract radially so that sanding element 218 can be removed.

Figure 5:
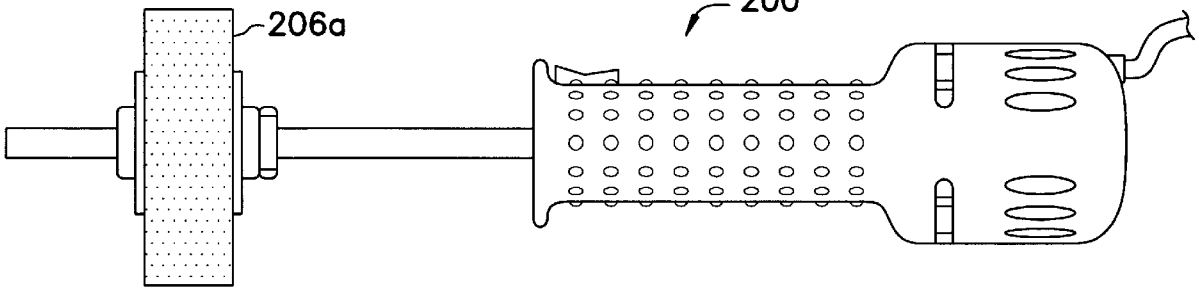
FIG. 5 is a side view in elevation of another embodiment of a power sander constructed according to the teachings of the present invention.

In this embodiment, rubber drum 206 is removable from motor shaft assembly 208. This allows power sander 200 to be used in a variety of applications by allowing different sized rubber drums to be placed at various points on motor shaft assembly 208. For example, a rubber drum that is sized for end-sanding operations can be used as shown in FIG. 5. In addition to sandpaper sleeves on a rubber drum, embodiments of the present invention use other conventional sanding accessories. For example, power sander 200 of FIG. 5 illustrates the use of a sanding stone for sanding assembly 206. In such a configuration, power sander 200 can be used to sharpen lawn mower blades, smooth a surface on a pipe, or any other conventional sanding stone operation.

Second handle 204 includes channel 220 with first and second spring loaded ball bearings 221*a* and 221*b* that engage groove 222 in shaft 224. It is noted that in another embodiment, groove 222 can be replaced with a ridge that extends along at least a portion of the circumference of shaft 224 so as to engage spring loaded bearings 221*a* and 221*b*. Shaft 224 is rotatably coupled to motor shaft assembly 208 at first end abutment 210.

In operation, sanding element 218 is placed on rubber drum 206 prior to a sanding operation. One of the nuts 214 is first loosened so that rubber drum 206 contracts radially. Sanding element 218 is then placed over rubber drum 206. Nut 214 is tightened, thus forcing first and second end abutments 210 and 212 together and causing the diameter of rubber drum 206 to expand to engage and hold sanding element 218 in place.

Second handle 204 is placed on power sander 200 to allow increased stabilization when sanding contours on the edge of a piece of wood. Channel 220 of second handle 204 is place over shaft 224. The bearings of spring loaded bearings 221*a* and 221*b* slide inward against the pressure of their respective springs. When second handle 204 reaches a position such that spring loaded bearings 221*a* and 221*b* are located at a position over groove 222, the springs of spring loaded bearings 221*a* and 221*b* force the bearings into place so as to connect second handle 204 to power sander 200.

Conclusion

Although specific embodiments have been illustrated and described in this specification, it will be appreciated by those of ordinary skill in the art that any arrangement that is calculated to achieve the same purpose may be substituted for the specific embodiment shown. This application is intended to cover any adaptations or variations of the present invention. For example, the specific configuration of the motor shaft assembly can be altered from the single shaft as shown. Rather, a second shaft may be placed within the rotating shaft that extends to allow the second handle to be connected to the second shaft. Further, the shape of the first and second handles can be altered from those shown in the Figures. Drum 206 can also be made from other materials that allow the drum to expand and contract by a sufficient amount so as to hold the sanding element in place during a sanding operation. More than two spring loaded ball bearings can be used to hold the removable handle in place. Other mechanisms can be used in place of the spring loaded bearings to allow the removable handle to connect to the power sander. For example, shaft 224 could be threaded to mate with a threaded portion inside channel 220 of second handle 204. Alternatively, other conventional mechanisms that allow the second handle to snap onto the power sander can be substituted without departing from the spirit and scope of the present invention.

What is claimed is:

1. A power sander, comprising:

an electric motor;

a motor shaft assembly extending axially from the electric motor;

a first handle that houses the electric motor with the motor shaft assembly extending from one end of the handle along an axis of the first handle;

a sanding assembly coaxial with the motor shaft assembly and engageably coupled with the motor shaft assembly so as to rotate around the axis of the motor shaft assembly under control of the electric motor;

a stabilizing, second handle that is detachably coupled to snap on to the motor shaft assembly on a side of the sanding assembly opposite, and coaxial with the first handle;

means for detachably connecting the second handle to the motor shaft assembly; and wherein the means for detachably connecting the second handle to the motor shaft assembly comprises a spring loaded bearing in an end of the motor shaft assembly and a mating groove in a channel within the second handle.

2. The power sander of claim 1, wherein the second handle includes a channel for receiving an end of the motor shaft assembly.

3. The power sander of claim 1, wherein the sanding assembly comprises:

a rubber drum with a channel through which the motor shaft assembly passes;

first and second end abutments that are slidably coupled to the motor shaft assembly at opposite ends of the rubber drum;

a bolt threadably attached to the motor shaft assembly adjacent to one of the end abutments; and a replaceable sanding element that passes over the rubber drum and is held in place by tightening the bolt against the adjacent end abutment.

4. The power sander of claim 1, wherein the motor shaft assembly comprises a single piece shaft.

5. The power sander of claim 1, wherein the first handle also includes a switch that is disposed on the handle and coupled to the electric motor to control power and speed of operation.

6. A power sander, comprising:

unitary motor shaft;

a first handle;

a sanding assembly;

a stabilizing, second handle that is detachably coupled to snap on to the motor shaft;

wherein the first and second handles and the sanding assembly are in axial alignment on the motor shaft; and wherein the stabilizing handle includes spring loaded bearings for engageably coupling to the motor shaft.

7. The power sander of claim 6, and further including an electric motor disposed in the first handle and engageably coupled to the motor shaft.

8. The power sander of claim 6, wherein the sanding assembly includes a sanding element that is disposed on a rubber drum on the motor shaft.

9. The power sander of claim 6, wherein the first handle includes a portion with a reduced diameter for grasping by a user.

10. The power sander of claim 9, and further including a switch disposed in the tapered portion of the first handle.

11. A power sander, comprising:

a unitary motor shaft;

a first handle;

a stabilizing, second handle that is detachably coupled to snap on to the motor shaft;

wherein the first and second handles are in axial alignment with the motor shaft so as to provide a space between the first and second handles to receive a sanding assembly; and wherein the stabilizing handle includes spring loaded bearings for engageably coupling to the motor shaft.

12. The power sander of claim 11, and further including an electric motor disposed in the first handle and engageably coupled to the motor shaft.

13. The power sander of claim 11, and further including a sanding element that is disposed on a rubber drum on the motor shaft.

14. The power sander of claim 11, wherein the first handle includes a portion with a reduced diameter for grasping, by a user.

15. The power sander of claim 14, and further including a switch disposed in the tapered portion of the first handle.

16. A power sander, comprising:

an electric motor;

a motor shaft assembly extending axially from the electric motor;

a first handle that houses the electric motor with the motor shaft assembly extending from one end of the handle along an axis of the first handle;

a sanding assembly coaxial with the motor shaft assembly and engageably coupled with the motor shaft assembly so as to rotate around the axis of the motor shaft assembly under control of the electric motor;

a stabilizing, second handle that is detachably coupled to snap on to the motor shaft assembly on a side of the sanding assembly opposite, and coaxial with the first handle;

means for detachably connecting the second handle to the motor shaft assembly; and wherein the means for detachably connecting the second handle comprises at least one spring loaded bearing in the second handle and a mating groove in the motor shaft.

17. A power sander, comprising:

an electric motor;

a motor shaft assembly extending axially from the electric motor;

a first handle that houses the electric motor with the motor shaft assembly extending from one end of the handle along an axis of the first handle;

a sanding assembly coaxial with the motor shaft assembly and engageably coupled with the motor shaft assembly so as to rotate around the axis of the motor shaft assembly under control of the electric motor;

a stabilizing, second handle that is detachably coupled to snap on to the motor shaft assembly on a side of the sanding assembly opposite, and coaxial with the first handle; and wherein the first handle also includes a switch that is disposed on the handle and coupled to the electric motor to control power and speed of operation.

18. The power sander of claim 17, and further comprising means for detachably connecting the second handle to the motor shaft assembly.

19. The power sander of claim 18, wherein the means for detachably connecting the second handle comprises at least one spring loaded bearing in the second handle and a mating groove in the motor shaft.

* * * * *